US008720579B2

(12) United States Patent
Reynolds et al.

(10) Patent No.: US 8,720,579 B2
(45) Date of Patent: May 13, 2014

(54) EMERGENCY BLOWOUT PREVENTER (EBOP) CONTROL SYSTEM USING AN AUTONOMOUS UNDERWATER VEHICLE (AUV) AND METHOD OF USE

(75) Inventors: Graeme E. Reynolds, Houston, TX (US); Robert A. Johnigan, Houston, TX (US); Greg R. Boyle, Houston, TX (US); Shelley Reynolds, legal representative, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 6 days.

(21) Appl. No.: 13/184,153

(22) Filed: Jul. 15, 2011

(65) Prior Publication Data

US 2012/0037375 A1 Feb. 16, 2012

Related U.S. Application Data

(60) Provisional application No. 61/364,735, filed on Jul. 15, 2010.

(51) Int. Cl.
*E21B 33/06* (2006.01)

(52) U.S. Cl.
USPC ..... 166/341; 166/339; 166/363; 166/364; 166/368; 166/85.4

(58) Field of Classification Search
USPC ..... 166/338, 339, 340, 341, 363, 364, 85.4, 166/368, 350; 414/137.5
See application file for complete search history.

(56) References Cited

U.S. PATENT DOCUMENTS

| | | | | |
|---|---|---|---|---|
| 6,032,742 | A * | 3/2000 | Tomlin et al. | 166/345 |
| 2007/0173957 | A1* | 7/2007 | Johansen et al. | 700/9 |
| 2009/0056936 | A1* | 3/2009 | McCoy, Jr. | 166/250.01 |
| 2009/0194290 | A1* | 8/2009 | Parks et al. | 166/339 |
| 2009/0260830 | A1* | 10/2009 | Hansen | 166/339 |
| 2009/0287414 | A1* | 11/2009 | Vickery | 701/220 |
| 2011/0291854 | A1* | 12/2011 | Morley et al. | 340/850 |
| 2012/0000646 | A1* | 1/2012 | Liotta et al. | 166/85.4 |
| 2013/0019964 | A1* | 1/2013 | Abicht et al. | 137/455 |

* cited by examiner

*Primary Examiner* — James Sayre
(74) *Attorney, Agent, or Firm* — Gary R. Maze; Berenbaum Weinshienk PC

(57) ABSTRACT

An autonomous underwater vehicle (AUV) may be programmed and launched to interface with an emergency blowout preventer which has been fitted, either when new or retrofitted, with an emergency BOP control system (EBOP). The EBOP is a "black box" drop-in solution for projects such as emergency well control that can be retrofitted to existing BOP systems or added to new BOP systems and comprises one or more control docking stations, each adapted to receive autonomous underwater vehicle (AUV); one or more interface units connected to the control docking station and used to provide an interface between the control docking station and a BOP; and the AUV which is dimensioned and configured to autonomously mate with the control docking station and effect controls of the BOP.

24 Claims, 2 Drawing Sheets

EMERGENCY BLOWOUT PREVENTER (EBOP) CONTROL SYSTEM USING AN AUTONOMOUS UNDERWATER VEHICLE (AUV) AND METHOD OF USE

The present application claims priority in part through U.S. Provisional Application 61/364,735 filed Jul. 15, 2010.

BACKGROUND

1. Field of the Invention

Underwater blowout preventer (BOP) systems can require intervention or specific controls that are not otherwise available from the control system(s) present at the BOP. In these situations, typically emergency situations, the BOP requires provision of an external control system.

2. Background

During certain situations, a surface located control may lose communications and/or electrical connections to a subsea BOP. In these situations, it would be advantageous to have an automated, autonomous vehicle deployed to the BOP to keep the BOP operating correctly.

Current methods for emergency blowout preventer control include using a tethered remotely operated vehicle (ROV) with wet-matable subsea connector but this requires all the ancillary equipment to run the ROV. Close proximity acoustics are available for use with a ROV, but they are not able to transfer power.

FIGURES

Figure 1:
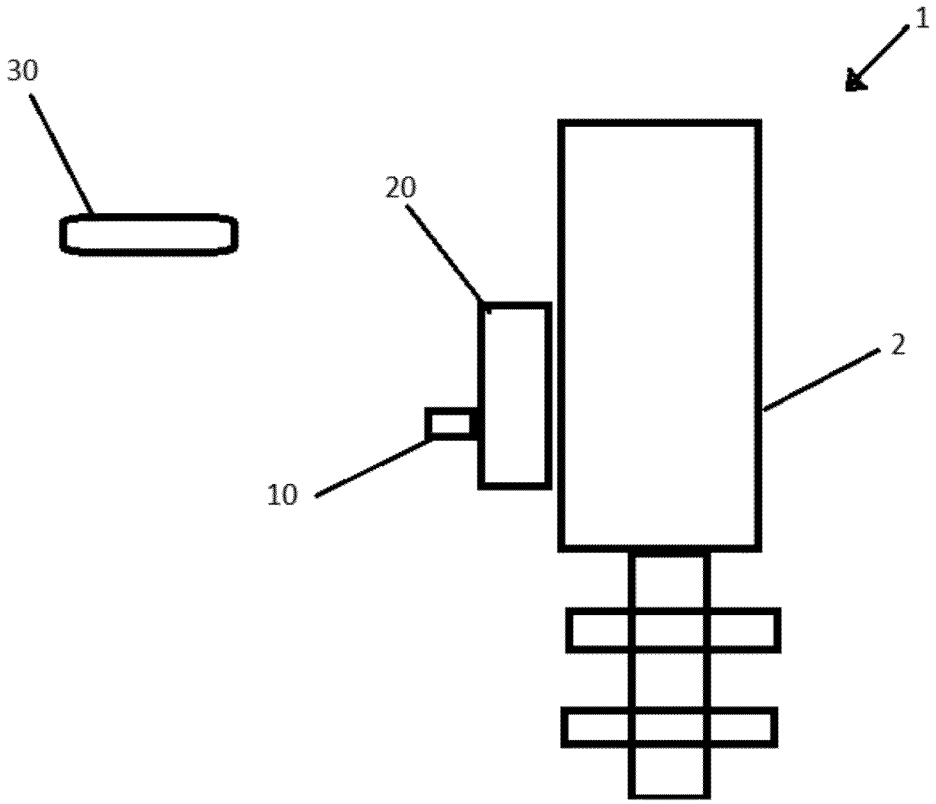
Figure 2:
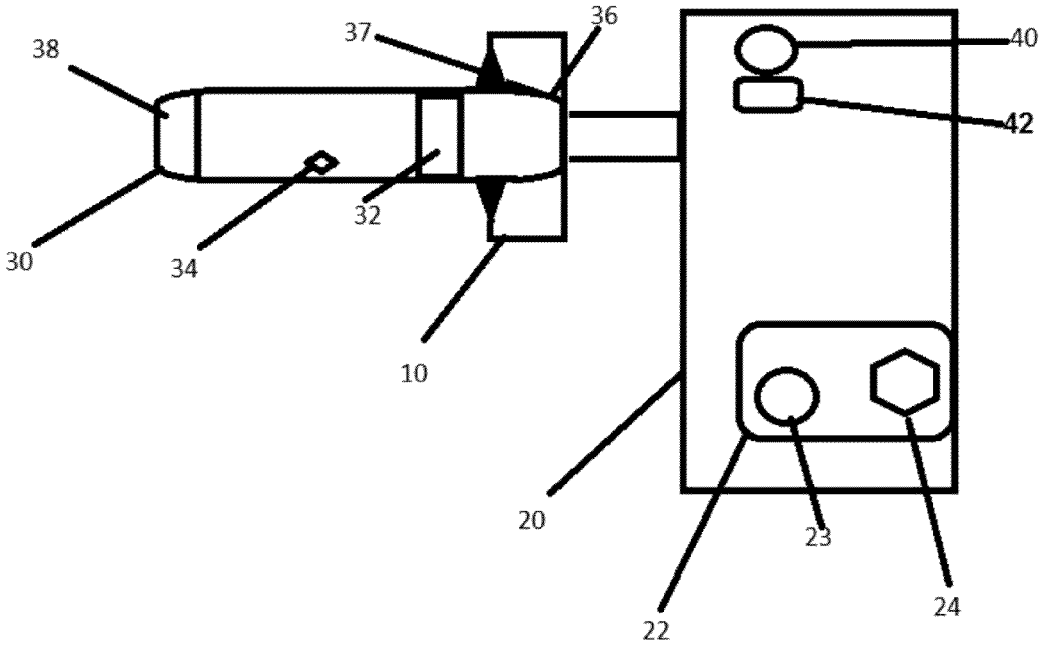

FIG. 1 is a block diagram of an exemplary embodiment of an emergency BOP control system; and FIG. 2 is a block diagram of an exemplary AUV, control docking station, and interface unit.

DESCRIPTION OF EXEMPLARY EMBODIMENTS

Referring now to FIGS. 1 and 2, emergency BOP (EBOP) control system 1 is a "black box" drop-in solution for projects such as emergency well control that can be retrofitted to existing BOP systems or added to new BOP systems. EBOP 1 comprises one or more control docking stations 10, each adapted to receive autonomous underwater vehicle (AUV) 30; one or more interface units 20 connected to control docking station 10 and used to provide an interface between control docking station 10 and BOP 2; and AUV 30 which is dimensioned and configured to removably mate with control docking station 10.

Typically, control docking station 10 can be mounted in interface unit 20. Each control docking station 10 may optionally have a unique, queryable address, although such is not required. As used herein, an address can be electronically queried or mechanically queried, e.g. the mechanical address may comprise alphanumeric characters that can be optically detected by a camera such as by pattern recognition. If present, the unique address of docking control station 10 may be based on the address of the interface unit 20 with which it is associated, e.g. 123456-1, 123456-2, and so on for interface unit 20 that has an address of 123456). An electronic address may be read and verified through docking control station 10. The addressing would prevent AUV 30 from connecting to control docking station 10 if AUV 30 is not at the correct control docking station 10.

In preferred embodiments, each interface unit 20 is dimensioned and configured to provide an interface between control docking station 10 and BOP 2. Typically as well, interface unit 20 is dimensioned and configured to allow interface unit 20 to house one or more control docking stations 20. Further, interface unit 20 typically comprises a unique address, such as an electronic address, a mechanical address, or the like, or a combination thereof.

In preferred embodiments, interface unit 20 further comprises an interface adapted to connect to BOP 2 and thereby operatively interface with BOP 2, such as a hydraulic interface, an electrical interface, a communications interface, or the like, or a combination thereof. Additionally, interface unit 20 may further comprise one or more computers/electronics, solenoids, valves accumulators, controllers, and the like, or combinations thereof.

Interface unit 20 may comprise power supply 22, although it does not have to. In certain embodiments, power supply 22 comprises one or more batteries 23, fuel cells 24, or the like, or a combination thereof. Power supply 22 may be in modular form for subsea replacement.

In certain currently contemplated embodiments, battery 23 may comprise a predetermined number of redundant, replaceable battery packs. It may also be desirable to have battery 23 comprise an interface to BOP 2, the interface dimensioned and adapted to receive a redundant charge from BOP 2.

However, interface unit 20 may not contain any self-powered device and may be electrical powered from AUV 30.

In typical configurations, AUV 30 further comprises navigation system 32 and one or more sensors 34 which are in communication with navigation system 32. Sensors 34 are dimensioned and configured to aid in allowing AUV 30 to autonomously navigate to a pre-programmed known location such as a location of BOP 2.

AUV 30 further comprises mating system 36 which is dimensioned and configured to allow AUV 30 to dock with control docking station 10. In certain embodiments, mechanical deployment system 37 may be present.

Additionally, AUV 30 may be equipped with a manual and/or automatic mechanical deployment system and an autostart system. Such an autostart system could be operable as a water detector that, once AUV 30 is placed in water, would start AUV 30 automatically.

While on a rig (not shown in the figures), AUV 30 can be in standby mode through a connection through its AUV mating system (not shown in the figures). In standby mode, the address of a desired interface unit 20 and the desired function assignments may be programmed into AUV 30. It is contemplated that standby mode would be the normal mode while AUV 30 is sitting in standby.

In standby mode and through the mating system, AUV 30 can have a trickle charge to its batteries and a communication heartbeat signal for health. The batteries can be periodical tested internally to verify their health such as through electronic techniques like load testing, AC-Impedance, Laplace pulsing, and the like or a combination thereof.

Through the mating system and a handheld and/or fixed terminal, AUV 30 can be set with the target unique address of interface unit 20 and with one or more pre-determined functions to perform once mated with that interface unit 20. Optionally, default functions may exist to run in the event AUV 30 is not programmed. A pre-determined test mode may be entered as well.

An AUV test mode may be present in AUV 30 which executes one or more pre-determined test sequences. After a pre-determined number of days, AUV 30 may exit test mode automatically and go back to standby mode, e.g. if no one updates the AUV program.

A quick mode may also be present in the event that a last minute change is desired, e.g. to the function to be preformed such as for a mechanical system, levers, mechanical magnets, and the like. The quick set mode may further allows for a quick set up of a pre-determined function with the address of interface unit 20 already in place and deploy.

AUV 30 may further comprise mechanical back end latch 38 such that if AUV 30 dies, e.g. at control docking station 10, an ROV can be used to disengage AUV 30.

Control docking station 10 provides a means for AUV 30 to attach itself to interface unit 20, e.g. mechanically, and may further provide an electrical power and/or communications connections for AUV 30 to interface to interface unit 20. Power could go both ways, e.g. if BOP 2 power is present and charging up batteries 23 in interface unit 20, power may also be provided to charge batteries in AUV 30. Once AUV 30 has done its job and has fresh batteries 23, it may resurface with "function execution conformation". If there is no stack power in BOP 2, EBOP 1 can combine energy to optimize operation of interface unit 20 and AUV 30 to execute the desired function.

Communications interface 40 may be present to operatively provide communications with interface unit 20. This may further comprise close proximity acoustic communications device 42 operatively in communication with interface unit 20.

As will be understood by one of ordinary skill in these arts, EBOP 1 may have multiple variations, e.g. multiple interface units 10 with a single control docking station 20; one interface unit 10 with multiple control docking stations 20; and the like.

In the operation of a preferred embodiment, during situations such as an extreme emergency that involves a surface to subsea loss of communications and/or electrical power and/or hydraulics to BOP 2, an un-tethered AUV 30 can be deployed from the surface location of BOP 2 such as by an on-station drilling rig or any surface vessel that has an AUV 30 designed for this specific task. In certain contemplated embodiments, deployment of AUV 30 may be automotive if a rig goes down. Moreover, EBOP 1 may have a "fireman pole" for potential energy deployment from the rig or some other means that would not depend on any rig power. Further, AUV 30 may be launched manually such as from workboats, fishing boats, and the like, or a combination thereof.

In a first preferred embodiment, autonomous support may be provided to underwater BOP 2. EBOP 1, as described above, may be positioned proximate BOP 2. Positioning EBOP 1 proximate BOP 2 may be by retrofitting EBOP 1 to an existing BOP 2 or adding EBOP 1 to a new BOP 2.

AUV 30 is programmed and allowed to navigate to EBOP 1, typically autonomously, utilizing one or more self-contained on board sensors 34, to a pre-programmed known location of BOP 2.

Once at control docking station 10, AUV 30 is received into control docking station 10 and allowed to become attached to control docking station 10.

Typically, once AUV is proximate control docking station 10 or docked at control docking station 10, communications are established between AUV 30 and interface unit 20. In certain embodiments, AUV 30 comprises a communications port which is used to query interface unit 20 such as for its address or to obtain a status of at least one of interface unit 20 or BOP 2 via a series of diagnostic tests that can be performed on a routine or as needed basis, or the like, or a combination thereof. As noted above, communication between AUV 30 and interface unit 20 may be established by using close proximity acoustic communications device 42 operatively in communication with interface unit 20 or via inductive communications, or the like, or a combination thereof. Further, inductive power may be provided for the link between control docking station 10 and AUV 30. For example, magnetic coupling operates in "near field" versus "far field" for radio frequencies (RF). EMC testing has shown that inductive coupling is very immune to EMI (electromagnetic interference) and very quiet for EM emissions. An inductive communications that uses no RF carrier has many advantages—nothing to adjust for production, and nothing to drift over time, temperature or age.

AUV 30, which itself may have at least one of a unique electronic address or a unique electronic mechanical address, obtains the unique location address assigned to EBOP 1 via interface unit 20. AUV 30 is then allowed to perform a predetermined BOP-related action such a predetermined method of control of BOP 2. By way of example and not limitation, the predetermined method of control of BOP 2 may comprise administering a predetermined set of control commands that will result in the shut in of the subsea well bore to which BOP 2 is interfaced.

It may be desirable to allow the establishing of communications with a surface vessel and allow uni- or bi-directional communication of data, which may include control commands, between the surface vessel and interface unit 20. The AUV performed predetermined function may be locked into a steady state after the AUV performs the function. For example, once shear rams are activated it is not desirable to have a dying battery 23 allow a shear ram solenoid to go back to an unfired position and open the shear rams.

In certain situations, a remotely operated vehicle (ROV) may be piloted to a location proximate EBOP 1 and used to effect control of interface unit 20. In these situations, the ROV may interface with interface unit 20 to allow establishing communications between the ROV and interface unit 20. Once communications are established, the ROV may be used to perform the same command protocols as AUV 30 would perform. The coordinated architecture of interface unit 30 and control docking station 10 can be configured to allow interface with an on-station drilling rig ROV. This will allow the ROV to establish communications and be able to perform the same command protocol as the AUV during an emergency or for routine testing of EBOP 1. This offers a layer of redundancy to control BOP 2 and increase the overall reliability of the function it needs to perform.

In a second contemplated mode of operation, autonomous support to BOP 2 may be provided by positioning an EBOP 1 proximate BOP 2.

AUV 30 may be pre-programmed with a set of data, the set of data comprising an address of a target interface unit 20 and control commands to provide to interface unit 20 and/or BOP 2. The AUV would get its pre-determined EBOP Interface Unit (IU) Address and docking station loaded into the AUV through the AUV mating system (MS) via handheld/fixed terminal.

AUV is maneuvered to a location proximate interface unit 20, e.g. autonomously. In a currently envisioned embodiment, AUV 30 is provided its current latitude and longitude position via a GPS as well as with the latitude and longitude position of a target interface unit 20. One or more sensors 34 onboard AUV 30 then are used to provide AUV 30 with a 3D heading to allow AUV 30 to navigate to the target interface unit 20, control docking station 10, or a combination thereof.

Once present at control docking station 10, AUV establishes communications with interface unit 20 and verifies the unique address of control docking station 10 is the address of the target interface unit 20. This can be accomplished by having the AUV read the address of interface unit 20 such as electronically and/or optically once AUV 30 attaches to control docking station 10, and then having a control system onboard AUV 30 verify that the address of interface unit 20 matches the target address in AUV 30.

If verified, AUV 30 docks with control docking station 10, e.g. mechanically attaches itself to interface unit 20, and establishes data communications between AUV 30 and interface unit 20. A control system, e.g. microprocessor, onboard AUV 30 then performs a pre-determined BOP-related action, e.g. shut down the well. In certain embodiments, once a match is verified, AUV can automatically execute the pre-determined function.

If not verified, AUV 30 may detach itself and autonomously continue to look for an interface unit 20 which has the correct, matching address.

In certain embodiments, AUV 30 will detach itself from control docking station 10 and resurface if the predetermined function is correctly executed. In other contemplated embodiments, AUV 30 would be like a salmon: it does its job and then dies.

Under non-emergency conditions AUV 30 will also have the capability, through a communications port of control docking station 10, to query for a status of interface unit 20 such as via a series of diagnostic tests that can be performed on a routine or as needed basis.

System must handle multiple AUV's showing up at the same time. May need algorithm to randomly back off and try again. The thought would be for the AUV to see the mechanical address of the EBOP Interface Unit (IU)/Docking station and then go in and attach itself to the docking station.

When the AUV has executed its function, it may elect to resurface and take a "function execution confirmation" with it.

If batteries are low, AUV 30 may not be able to slowly float to the top. Instead of using all its battery power, AUV 30 can be put in a minimum voltage state that shuts off everything but the GPS transmit beacon, so AUV 30 can quickly be found and verified that it has confirmation of the function execution on board.

If AUV 30 resurfaces, it may also have a log of its experience including "address not found," AUV failure, function performed, and the like, or a combination thereof.

The foregoing disclosure and description of the inventions are illustrative and explanatory. Various changes in the size, shape, and materials, as well as in the details of the illustrative construction and/or a illustrative method may be made without departing from the spirit of the invention.

We claim:

1. An emergency BOP (EBOP) control system, comprising:

a. a control docking station dimensioned for use with an autonomous underwater vehicle (AUV);

b. an interface unit connected to the control docking station, the interface unit dimensioned and configured to provide an interface between the control docking station and a functional controller of a blowout preventer (BOP), the interface unit further dimensioned and configured to allow the interface unit to house the control docking station, the interface unit comprising a power supply, the power supply comprising at least one of a battery, or a fuel cell and a first inductive power coupler operatively in communication with the power supply; and c. an AUV dimensioned and configured to removably mate with the control docking station and further comprising a second inductive power coupler dimensioned to cooperatively mate with the first inductive power coupler and to inductively have power transmitted between the second inductive power coupler and the first inductive power coupler.

2. The EBOP of claim 1 wherein the AUV further comprises:

a. a navigation system; and b. a sensor in communication with the navigation system, the sensor further dimensioned and configured to aid in autonomously navigating the AUV to a pre-programmed known BOP location.

3. The EBOP of claim 1 wherein the AUV further comprises:

a. a mating system dimensioned and configured to dock the AUV with the control docking station;

b. a mechanical deployment system; and c. an autostart system.

4. The EBOP of claim 1, wherein the interface unit comprises a plurality of interface units.

5. The EBOP of claim 1, wherein the control docking station comprises plurality of control docking stations.

6. The EBOP of claim 5, wherein each control docking station comprises an interface unit.

7. The EBOP of claim 1, wherein the interface unit is dimensioned and adapted to receive power from an AUV.

8. The EBOP of claim 1, wherein the interface unit further comprises an interface adapted to operatively connect to a BOP stack.

9. The EBOP of claim 8, wherein the interface comprises at least one of a hydraulic interface or an electrical interface adapted to operatively interface with the BOP.

10. The EBOP of claim 1, wherein the interface unit further comprises a controller.

11. The EBOP of claim 1, wherein the battery comprises a predetermined number of redundant, replaceable battery packs.

12. The EBOP of claim 1, wherein the battery comprises an interface to the BOP dimensioned and adapted to receive a redundant charge from the BOP.

13. The EBOP of claim 1, wherein the interface unit comprises a unique address.

14. The EBOP of claim 13, wherein the address is at least one of an electronic address or a mechanical address.

15. The EBOP control system of claim 1, further comprising:

a. a communications interface operatively in communication with the interface unit; and b. a close proximity communications device operatively in communication with the interface unit.

16. The EBOP control system of claim 15, wherein the close proximity device comprises a close proximity inductive communications device.

17. The EBOP control system of claim 15, wherein the close proximity device comprises a close proximity acoustic communications device.

18. The EBOP of claim 1, wherein the interface unit is dimensioned and configured to provide at least one of a data communications interface and a power interface between the AUV docking station and the BOP.

19. A method of providing autonomous support to an underwater blowout preventer, comprising:

a. positioning an emergency blowout preventer control system (EBOP) proximate a blowout preventer (BOP), the EBOP comprising:

i. a control docking station dimensioned and configured to selectively receive and disengage an autonomous underwater vehicle (AUV); and ii. an interface unit connected to the control docking station, the interface unit dimensioned and configured to provide an interface between the control docking station and the BOP, the interface unit further dimensioned and configured to allow the control docking station to mount to the interface unit;

b. allowing an AUV to autonomously navigate to the EBOP, the AUV comprising a control system;

c. receiving the AUV into the control docking station;

d. allowing the AUV to dock with the control docking station;

e. establishing communication between the AUV and the interface unit;

f. verifying a unique location address assigned to the EBOP via the interface unit; and g. allowing the AUV control system to perform a predetermined BOP-related control function.

20. The method of claim 19, wherein the communication established between the AUV and the interface unit is established inductively between an AUV inductive data communications coupler and a cooperatively configured interface unit inductive data communications coupler.

21. The method of claim 19, further comprising inductively providing electrical power between an AUV power coupler and a cooperatively configured interface unit inductive power coupler.

22. A method of providing autonomous support to an underwater blowout preventer, comprising:

a. positioning an emergency blowout preventer control system (EBOP) proximate a blowout preventer (BOP), the EBOP comprising:

i. an interface unit comprising a unique address;

ii. a control docking station dimensioned and configured to selectively receive and disengage an autonomous underwater vehicle (AUV), the control docking station dimensioned and adapted to be housed at least partially within the interface unit, the control docking station further comprising a unique address based on the interface unit unique address, the control docking station further dimensioned and configured to interface with the BOP;

b. programming an AUV with a set of data, the set of data comprising an target interface unit address and a target BOP location;

c. allowing an AUV to autonomously maneuver proximate the targeted interface unit;

d. verifying via the AUV that the interface unit unique address is the target address;

e. docking the AUV with the docking control station if the interface unit unique address is the target address;

f. establishing communication between the AUV and the interface unit;

g. verifying a unique location address assigned to the EBOP via the interface unit; and h. allowing the AUV control system to perform a predetermined BOP-related control function.

23. The method of claim 22, wherein the communication established between the AUV and the interface unit is established inductively between an AUV inductive data communications coupler and a cooperatively configured interface unit inductive data communications coupler.

24. The method of claim 22, further comprising inductively providing electrical power between an AUV power coupler and a cooperatively configured interface unit inductive power coupler.

* * * * *